US005271681A

United States Patent [19]

Otsuka et al.

[11] Patent Number: 5,271,681

[45] Date of Patent: Dec. 21, 1993

[54] PAPER CASSETTE HAVING INCLINED CORNER CLAWS

[75] Inventors: Fumio Otsuka; Hiroyuki Harada; Akio Tajima; Noriyuki Kurokawa; Masami Nojima, all of Tokyo, Japan

[73] Assignee: Seikosha Co., Ltd., Tokyo, Japan

[21] Appl. No.: 878,138

[22] Filed: May 4, 1992

[30] Foreign Application Priority Data

May 24, 1991 [JP] Japan ..... 3-037256[U]

[51] Int. Cl.[5] ..... B41J 13/16

[52] U.S. Cl. ..... 400/625; 400/644; 271/167

[58] Field of Search ..... 400/624, 625, 644, 645; 346/134; 271/167, 169, 170

[56] References Cited

U.S. PATENT DOCUMENTS 4,600,929 7/1986 Cardona et al. ..... 346/134
4,783,669 11/1988 Piatt et al. ..... 400/624
4,918,464 4/1990 Isshiki ..... 346/134
5,005,998 4/1991 Takanishi et al. ..... 400/624
5,015,109 5/1991 Brandon et al. ..... 400/624
5,054,759 10/1991 Lohrmann et al. ..... 400/624

*Primary Examiner*—Edgar S. Burr
*Assistant Examiner*—John S. Hilten
*Attorney, Agent, or Firm*—Jordan and Hamburg

[57] ABSTRACT

A paper cassette used in a printer for holding sheets of paper. The cassette comprises a case holding sheets of paper and corner claws mounted at both sides of the front end of this case. The claws engage the front ends of the corners of the uppermost sheet of paper. The claws have front walls which are inclined upwardly toward the direction in which the uppermost sheet is fed. The front walls are also inclined from the front end of the uppermost toward the direction in which the walls are distant from the front end of the sheet by slow degrees toward the inside of the widthwise of the sheet. When the uppermost sheet is curled, the corners of the front end of the sheet are disengaged from the corner claws certainly.

18 Claims, 7 Drawing Sheets

PAPER CASSETTE HAVING INCLINED CORNER CLAWS

FIELD OF THE INVENTION

The present invention relates to a paper cassette used in a printer or other similar machine.

BACKGROUND OF THE INVENTION

In a printer or other similar machine, a paper cassette holding sheets of paper is installed. The sheets of paper are fed out of this paper cassette.

This kind of paper cassette comprises a case holding sheets of paper, and corner claws are attached to both sides of the front end of the case. The claws act to curl and separate the uppermost sheet of paper. Each claw has a front wall opposite to the front fringe of each sheet of paper. The uppermost sheet of paper bears on this front wall and becomes curled. When the uppermost sheet of paper is curled, the corners of the front end of the uppermost sheet of paper move diagonally toward the inside of the widthwise of the sheet and disengage from the claws. The uppermost sheet of paper is therefore fed out of the case.

However, in this conventional paper cassette, the uppermost sheet of paper fails to be disengage from the corner claws in some cases. As a result, the paper jams.

Namely the front walls of the corner claws are perpendicular to the direction in which the uppermost sheet is fed. When the uppermost sheet should be fed, the front end of the sheet bears against the front walls of the claws at right angles. Therefore, when the sheet is curled, the corners of the front end of the sheet easily slide downwardly from the position at which the front end of the paper bears on the front walls of the claws. In some cases, the corners of the front end of the sheet slip under this position and fails to be disengaged from the corner claws.

Also, the front walls of the corner claws are parallel to the front end of the sheet of paper. When the sheet is curled and the corners of the front end of the uppermost sheet move toward the inside of the widthwise of the sheet, the corner claws are strong resistance. In some cases, the corners of the front end of the sheet fails to be disengaged.

SUMMARY OF THE INVENTION

It is an object of the present invention to provide a paper cassette which prevents the corners of the front end of the uppermost sheet of paper disengaging from the corner claws certainly when the sheet is curled to thereby improve the paper feeding operation.

The above object is achieved in accordance with the teachings of the invention by a paper cassette comprising: a case holding sheets of paper; and corner claws which are mounted to both sides of the front end of the case and engaged the corners of the front end of the uppermost sheet of paper. When the uppermost sheet should be fed, the claws curl it to separate it. The corner claws have walls opposite to the front end of the uppermost sheet. The walls are inclined upwardly toward the direction in which the sheet is fed.

The above object is achieved in accordance with the teachings of the invention by the other paper cassette comprising: a case holding sheets of paper; and corner claws which are mounted to both sides of the front end of the case and engage the corners of the front end of the uppermost sheet of paper. When the uppermost sheet should be fed, the claws curl it to separate it. The corner claws have walls opposite to the front end of the uppermost sheet. The walls are inclined toward the direction in which the walls are distant from the front end of the sheet by slow degrees toward the inside of the widthwise of the sheet.

In the novel paper cassette, when the uppermost sheet of paper is curled, the corners of the front end of the sheet do not easily slip downwardly from the corner claws because the walls of the claws are tilted upwardly toward the direction in which the sheet is fed. Therefore, the corners of the front end of the sheet are prevented from slipping under the claws.

In the other paper cassette, when the uppermost sheet of paper is curled, the corners of the front end of the uppermost sheet of paper move easily toward the inside of the widthwise of the sheet because the walls of claws that are opposite to the front end of the sheet are tiled from the front end of the sheet.

Other objects and features of the invention will appear in the course of the description thereof which follows.

DETAILED DESCRIPTION OF THE INVENTION

Figure 1:
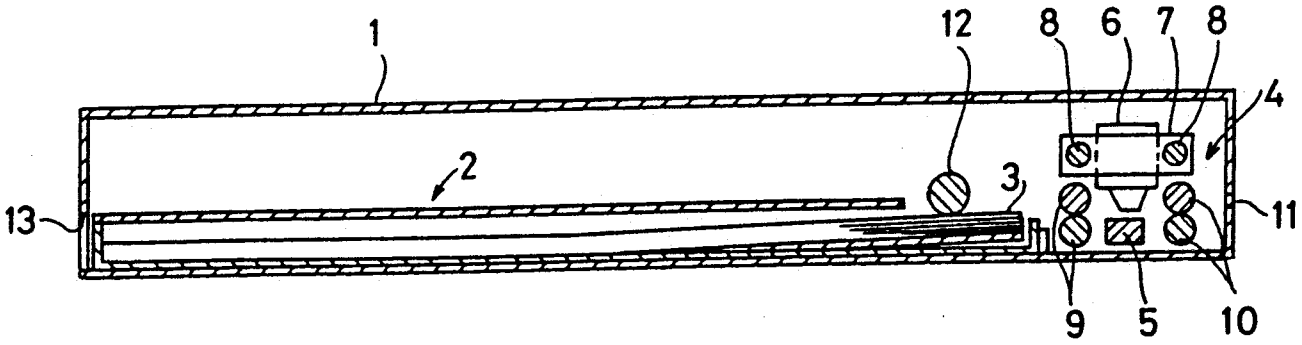
FIG. 1 is a vertical cross section of a printer using a paper cassette according to the invention.

Referring to FIG. 1, there is shown a printer having a boxlike case 1. A paper cassette 2 according to the invention is installed in the case 1. Sheets of paper 3 are successively fed out of this cassette 2 to a printing mechanism 4 to permit characters to be printed on the sheets.

The printing mechanism 4 comprises a platen 5 and a print head 0 that is disposed above and opposite the platen 5. Each sheet of paper 3 is transported between this head 0 and the platen 5, and then characters are printed on this sheet. The platen 5 extends perpendicular to the direction in which the sheet is fed, i.e., vertical to the plane of the sheet of FIG. 1, via anchoring means (not shown). The print head 6 is carried on a carrier 7 and can be moved with the carrier 7. The carrier 7 is held via guide shafts 8 so as to be movable parallel to the platen 5 and perpendicular to the direction of paper feeding. The carrier 9 is driven by a carrier motor (not shown).

Feed rollers 9 and discharge rollers 10 are mounted upstream and downstream, respectively, of the printing mechanism 4. These rollers 9 and 10 are rotated by a feed motor (not shown) and impart a transporting force to the uppermost sheet of paper 3. The sheet 3 is then transported to the printing mechanism 4. After characters are printed, the sheet is taken out of the printer case 1 through a discharge port 11 formed in the case 1.

Figure 5:
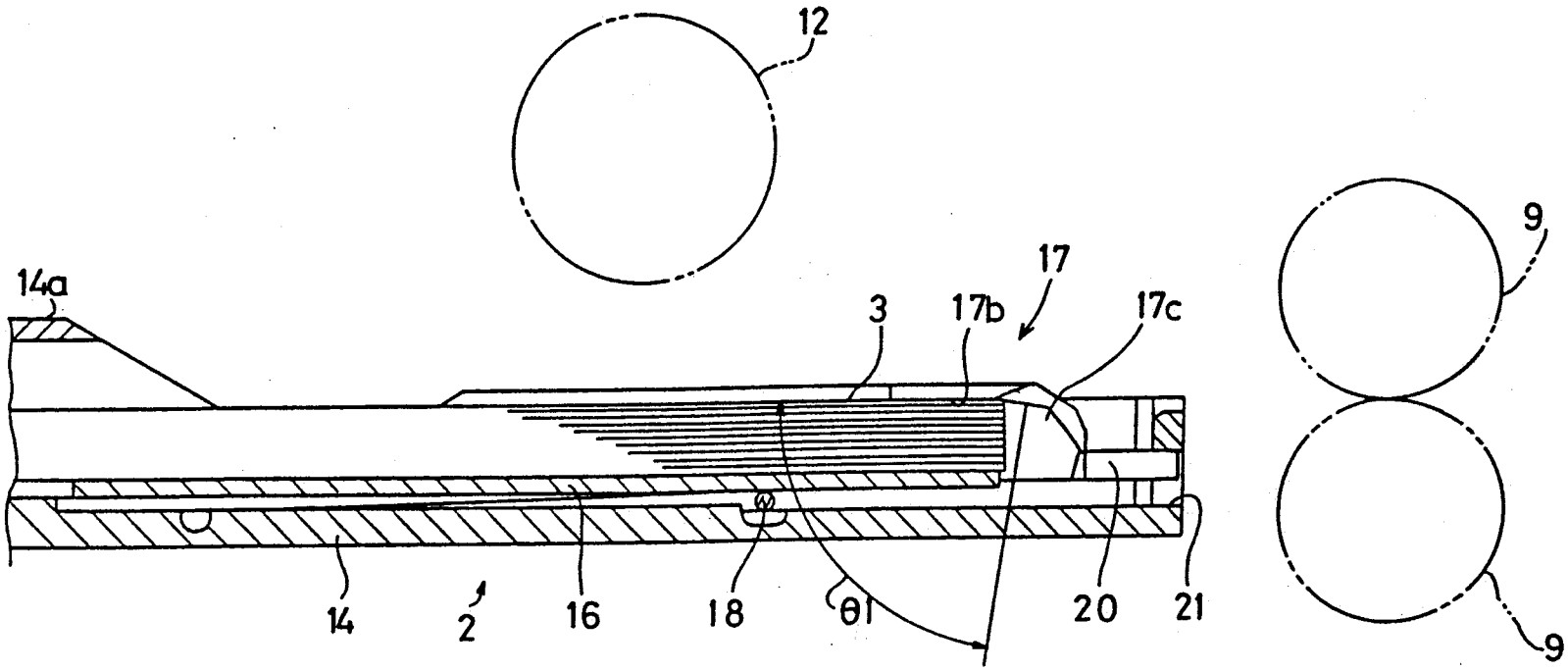
FIG. 5 is a view similar to FIG. 4, but in which sheets of paper have been placed in position.

A picking roller 12 is mounted above the front end of the paper cassette 2 in an opposite relation to this cassette. The picking roller 12 is rotated by the feed motor (not shown) as well as the feed rollers q and the discharge rollers 10 to take the sheet of paper 3 out of the cassette 2. When no sheet of paper is fed, the picking roller 12 is moved away from the uppermost sheet of paper 3, as shown in FIG. 5, by a picking mechanism (not shown). When the uppermost sheet is fed, the picking roller 12 is moved downwardly into abutment with the uppermost sheet 3 inside the cassette 2 by the picking mechanism as shown in FIG. 0. After the feeding, the picking roller 12 is again elevated and moved away from the sheet 3. One example of structure of this picking mechanism is described in Japanese Patent application Ser. No. 287048/1990 already filed by the present applicant.

Figure 2:
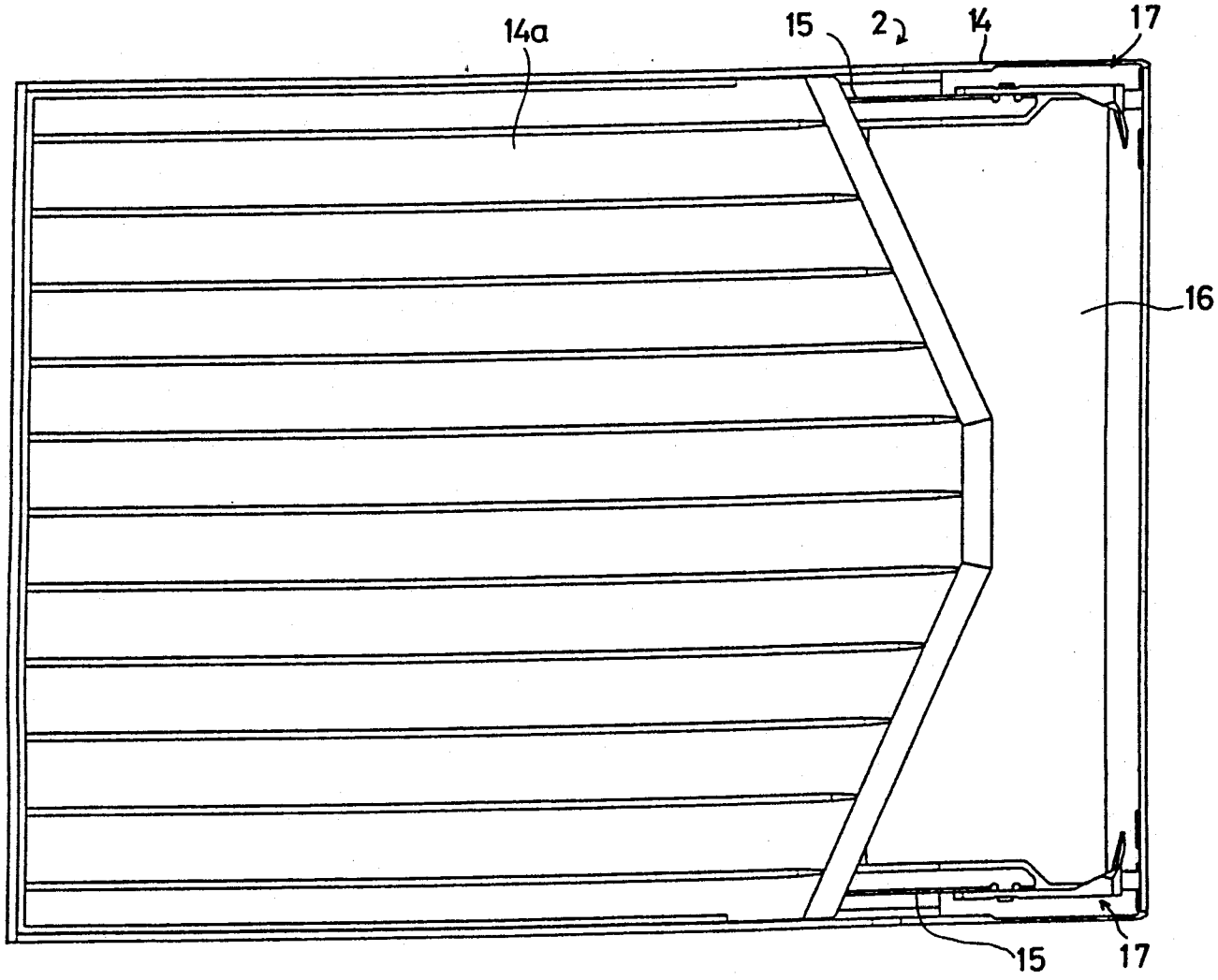
FIG. 2 is a plan view of the cassette shown in FIG. 1.

The paper cassette 2 can be inserted and withdrawn through a loading port 13 formed in the printer case 1 by pushing and pulling the cassette. The cassette 2 comprises a boxlike case 14 as shown in FIG. 2. Sheets of paper 3 are held within this case 11 as shown in FIG. 5. Side plates 15 extending upright are mounted inside both side surfaces of the case 14. The sheets of paper 3 are accommodated between the side plates 15. A cover 14*a* is detachably mounted to the case 14 and extends from the top portion of the case 14 to the vicinities of the front end of the case 14 so as not to interfere with the picking roller 12. When the sheets of paper 3 are set, the cover 14*a* can be detached if necessary.

A hopper plate 16 on which the sheets of paper 3 are placed is mounted inside the case 14 between the side plates 15. Corner claws 17 which engage the corners of the front end of the uppermost sheet of paper 3 are mounted at the front ends of the side plates 15. As shown in FIG. 5, the sheets of paper 3 are held among the claws 17 and the hopper plate 16.

Figure 4:
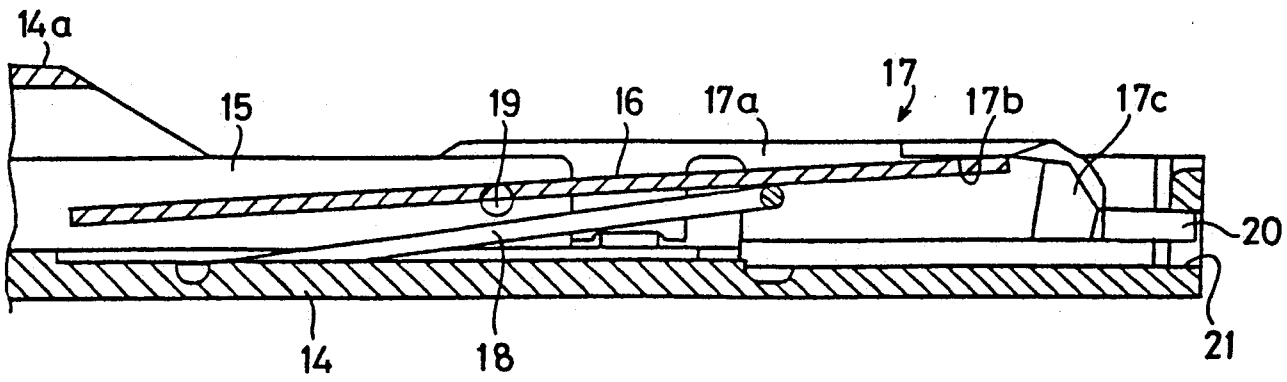
FIG. 4 is a cross-section view taken on line A—A of FIG. 3.

The hopper plate 10 is mounted to the bottom plate of the case 14 so as to be vertically swingable. As shown in FIG. 4, torsion springs 18 are mounted beneath the hopper plate 16 to bias the hopper plate 16 upward. The sheets of paper 3 are held among the corner claws 17 and the hopper plate 16 by the biasing force of the springs 18.

Figure 3:
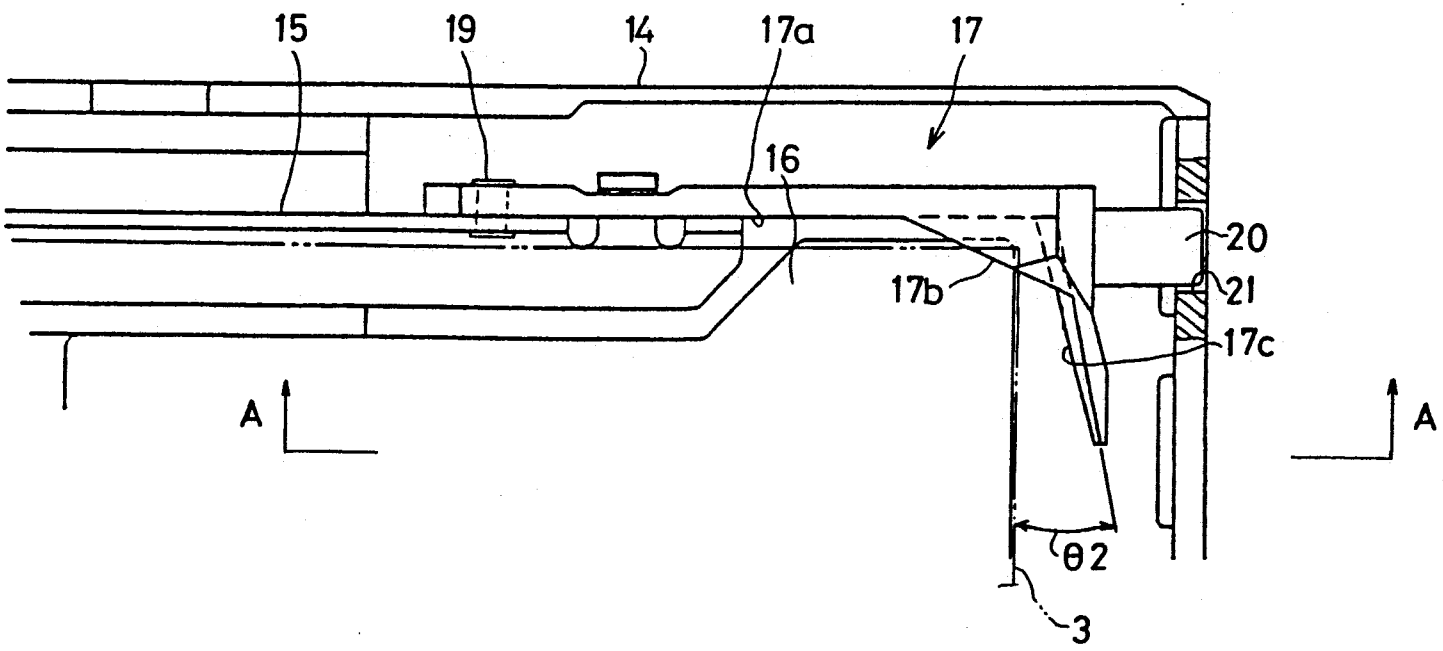
FIG. 3 is an enlarged plan view of main portions of FIG. 2.
Figure 6:
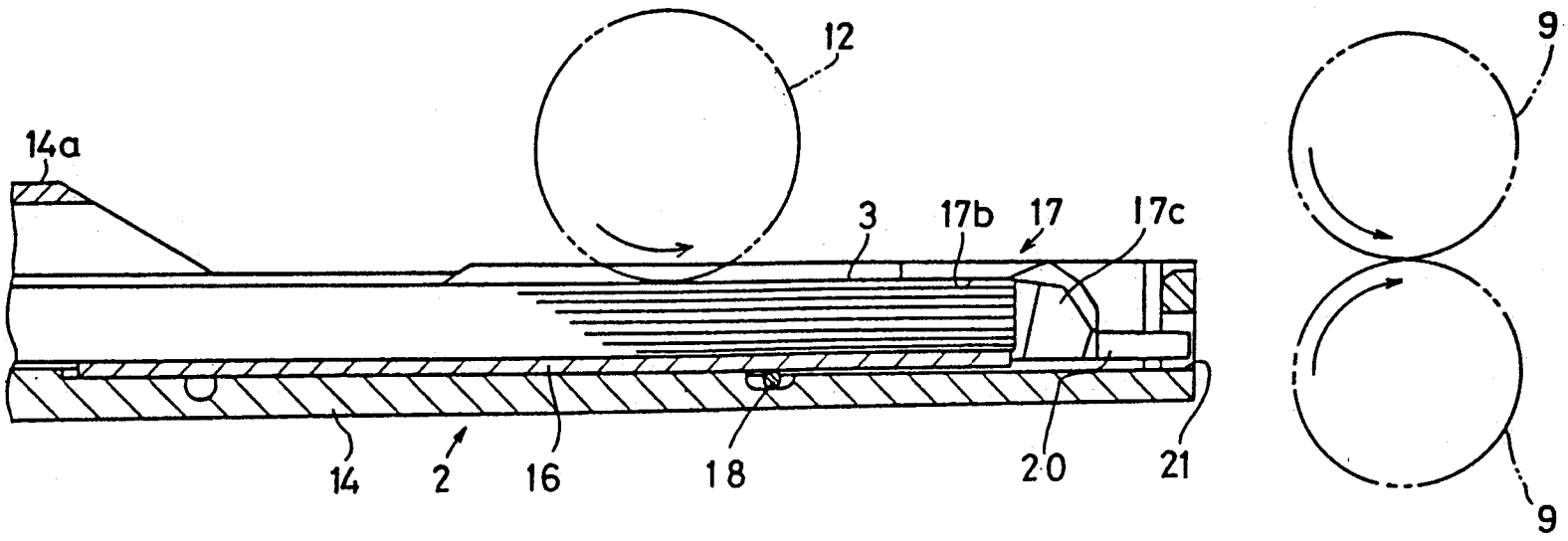
FIG. 6 is a view similar to FIG. 4, but showing a paper feeding operation.
Figure 7:
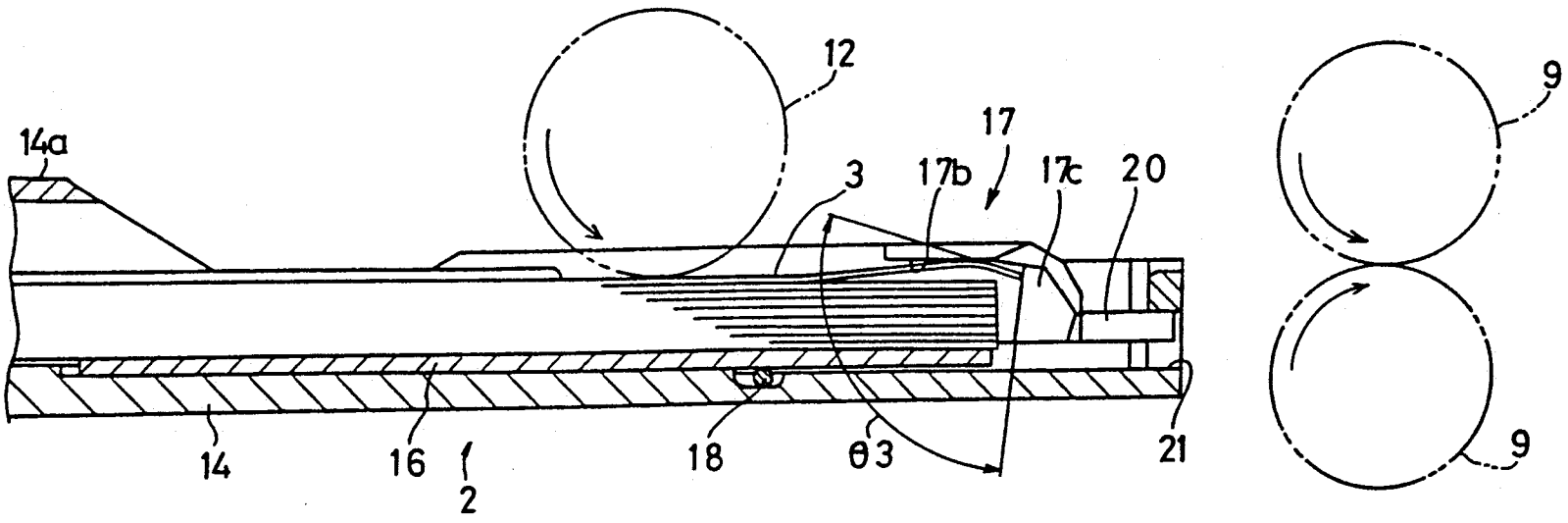
FIG. 7 is a view similar to FIG. 5, but showing a modification of the corner claws 17.

As particularly shown in FIGS. 3 and 4, the corner claws 17 are mounted to the side plates 15 via pins 10 so as to be swingable vertically. When the uppermost sheet of paper 3 is fed, the picking roller 12 is moved downward to push the sheet 3 downward. At this time, the corner claws 17 respond to the downward movement of the sheet 3 and move downward as shown in FIG. 6. As shown in FIG. 7, when the sheet 3 is curled, the claws 17 are pushed up by the curled sheet. A protrusion 20 is formed on the front of each corner claw 17. The protrusions 20 of the claws 17 are inserted in engagement holes 21 formed in the front plate of the case 14 to limit the swinging movement of the claws 17 to a given angular range.

As shown in FIGS. 3 and 4, each corner claw 17 is provided with a side wall 17*a*, an upper wall 17*b*, and a front wall 17*c*. The side wall 17*a* is disposed opposite to the corresponding side end of the sheet of paper 3 to limit lateral shift of the sheet 3. The upper wall 17*b* is disposed in an opposite relationship to the upper surface of the sheet of paper 3 and cooperates with the hopper plate 16 to hold the sheet of paper 3 therebetween. The front wall 17*c* is opposite to the front end of the sheet of paper 3. When the uppermost sheet of paper is fed, the front end of the uppermost sheet of paper bears against the front wall 17*c* and is curled to separate the uppermost sheet. As shown in FIG. 5, the front wall 17*c* is inclined upwardly from the plane of the uppermost sheet 3 toward the direction in which the sheet of paper is fed. Specifically, the angle $\theta 1$ (FIG. 5) made between the front wall 17*c* and the upper wall 17*b* is set less than 90 degrees. Thus, the front wall 17*c* is tilted upwardly from the plane of the sheet of paper 3 toward the direction of paper feeding, and also, as shown in FIG. 3, the front wall 17*c* is inclined from the front end of the sheet of paper 3 toward the widthwise of the paper 3 at angle $\theta 2$ so that the front wall 17*c* is distant from the front end of the sheet of paper 3.

The operation of this structure is described now. When the uppermost sheet of paper should be fed, the picking roller 12 is lowered as shown in FIG. 6 and bears against the uppermost sheet of paper 3 inside the paper cassette 2. During the downward movement of the picking roller 12, is pushes down the sheets of paper 3. The corner claws 17 move down while following the picking roller 12. Under this condition, the picking roller 12 gives a conveying force to the uppermost sheet 3. The uppermost sheet of paper 3 which undergoes this force abuts against the front walls 17*c* of the claws 17 and gets curled. Thus, the uppermost sheet 3 is separated and taken out of the cassette 2. When the sheet 3 is curled, it pushes up the claws 17 to prevent the sheet 3 from being curled to a great extent. After the uppermost sheet of paper 3 has been taken out of the cassette 2, the sheet is handed over to the feed rollers 9. The feed rollers 9 supply the sheet 3 between the print head 6 and the platen 5, and then characters are printed on the sheet. As soon as the sheet 3 is transferred to the feed rollers 9, there rollers 9 are moved upwardly away from the sheet 3. In this way, the picking roller 12 does not impede feeding of the sheet 3. After the printing, the sheet of paper 3 is sent to the discharge rollers 10, which in turn move the sheet out of the printer case 1 through the discharge port 11.

When the uppermost sheet of paper 3 is taken out of the paper cassette 3, the sheet 3 bears against the front walls 17*c* of the corner claws 17*c* and becomes curled. At this time, the corners of the front end of the sheet 3 is prevented from slipping downwardly because the front walls 17*c* of the corner claws 17 are upwardly inclined toward the direction in which the sheet 3 is fed (see FIG. 7). And also, the corners of the front end of the sheet 3 move easily toward the inside of the widthwise of the sheet 3 because the front walls 17*c* of the corner claws 17 inclined toward the direction in which the walls 17*c* of the corner claws 17 are distant from the front end of the sheet 3 by slow degrees toward the inside of the widthwise of the sheet 3. If the angle of the tilt of the front walls 17*c* is so set that when the sheet 3 is curled, the angle $\theta 3$ (FIG. 7) at which the sheet 3 bears against the front walls 17*c* does not exceed 90 degrees, then the corners of the front end of the sheet 3 are prevented from slipping downwardly with greater certainty. If the angle $\theta 2$ (FIG. 3) is more degrees, the corners of the front end of the sheet 3 move more easily toward the inside of the widthwise of the sheet 3. But, the desirable angle $\theta 2$ is about 15 degrees because of curling the corners of the front end of the sheet 3.

In this manner, when the uppermost sheet of paper 3 is curled, the corners of the front end of the sheet 3 is prevented from slipping downwardly, and also the corners of the front end of the sheet 3 move easily toward the inside of the widthwise of the sheet 3. The corners of the front end of the sheet 3 are therefore disengaged from the claws 17 certainly. Hence, the reliability of the paper feeding operation is improved.

In the above embodiment, the corner claws 17 are so held as to be capable of swinging vertically. Of course, the invention can be applied to a structure in which the corner claws 17 are stationary.

As described thus far, in the novel paper cassette, when the sheet is curled, the corners of the front end of the sheet are disengaged from the corner claws certainly. This enhances the paper feeding operation.

What is claimed is:

1. A paper cassette comprising:

a case means holding a stack of sheets of paper which are to be fed from the case means in a forward feed direction, said case means having a top and a bottom, said stack of sheets having an uppermost sheet disposed in a generally flat plane said sheets each having a forward leading edge, corner claw means on said case means, said corner claw means having inclined claw walls, said forward leading edge of said sheets in said stack being substantially disposed in a common plane which is disposed at an acute angle relative to said claw walls, said claw walls being operatively disposed forwardly of said leading edge of said sheets in said stack such that at least a part of the leading edge of said uppermost sheet in said stack abuts against said inclined claw walls as said uppermost sheet initially commences to be fed in said forward feed direction, said inclined claw walls being inclined downward and rearwardly from said uppermost sheet.

2. A paper cassette according to claim 1, wherein said case means has a longitudinal centerline parallel to said forward fed direction, said inclined claw walls being inclined relative to said centerline.

3. A paper cassette according to claim 1, wherein said uppermost sheet in said stack is disposed in a generally flat plane, said inclined walls extending at an acute angle relative to said flat plane.

4. A paper cassette according to claim 1, wherein each of said sheets of said stack has a corner portion juxtaposed to said corner claw means, each of said corner claw means having an overlying wall overlying said corner portions of said sheets in said stack.

5. A paper cassette comprising:

a case means holding a stack of sheets of paper which are to be fed from the case means in a forward feed direction, said case means having a longitudinal centerline parallel to said feed direction, said stack of sheets having an uppermost sheet, said sheets each having a forward leading edge, said case means having spaced sides extending generally parallel to said centerline, corner claw means disposed on said case means, said corner claw means having inclined claw walls the forward leading edge of said sheets in said stack being substantially disposed in a common plane which is disposed at an acute angle relative to said claw walls, said claw walls being operatively disposed forwardly of said leading edge of said sheets in said stack such that at least a part of the leading edge of said uppermost sheet in said stack abuts against said inclined claw walls as said uppermost sheet initially commences to be fed in said forward feed direction, said inclined claw walls being inclined at an acute angle relative said centerline.

6. A paper cassette according to claim 5, wherein said casing means has a top and a bottom, said inclined claw walls being inclined forwardly as the top of said case means is approached.

7. A paper cassette according to claim 5, wherein said case means has sides generally parallel to said longitudinal centerline, said inclined claw walls extending at an obtuse angle relative to the respective sides.

8. A paper cassette according to claim 5, wherein each of said sheets of said stack has a corner portion juxtaposed to said corner claw means, each of said corner claw means having an overlying wall overlying said corner portions of said sheets in said stack.

9. A paper cassette comprising:

a case means holding a stack of sheets of paper which are to be fed from the case means in a forward feed direction, said stack of sheets having an uppermost sheet, said sheets each having a forward leading edge, said case means having a front end portion juxtaposed to said forward leading edges of said stack of sheets, said case means having spaced sides extending from said front end portion in a direction generally parallel to said forward feed direction, said front end portion and said spaced sides forming front corners on said casing, corner claws disposed at said front corners, said corner claws each having a claw wall, the forward leading edge of said sheets in said stack being substantially disposed in a common plane which is disposed at an acute angle relative to said claw walls, said claw walls being operatively disposed forwardly of said leading edge of said sheets in said stack such that at least a part of the leading edge of said uppermost sheet in said stack abuts against said claw wall as said uppermost sheet commences to be fed, said claw wall being an inclined wall having an upper end inclined portion and a lower end inclined portion with said upper end inclined portion being downstream of said lower end inclined portion.

10. A paper cassette according to claim 9, wherein said spaced sides of said case means extend from said front end portion in a direction generally parallel to said forward feed direction, said case means having a longitudinal centerline parallel to said forward feed direction, one of said inclined walls extending between one of said sides and said centerline, the other of said inclined walls extending between the other of said sides and said centerline.

11. A paper cassette according to claim 9, wherein each inclined wall has an inner end portion and an outer end portion with said outer end portion being disposed further from said sides than said inner end portion and with said outer end portion being disposed downstream of said inner end portion considered in said forward feed direction.

12. A paper cassette according to claim 11, wherein each inclined wall is generally planar.

13. A paper cassette according to claim 11, wherein each inclined wall is disposed forwardly of said stack of sheets considered in said forward feed direction such that when the uppermost sheet in said stack is fed in said forward feed direction, a part of the forward leading edge of said uppermost sheet engages each inclined wall to effect curling of said uppermost sheet.

14. A paper cassette according to claim 13, wherein each said sheets of said stack has a corner portion juxtaposed to said corner claws, each of said corner claws having an overlying wall overlying said corner portion of said uppermost sheet in said stack, said overlying wall being engageable with said uppermost sheet to limit the extent of said curling of said uppermost sheet.

15. A paper cassette comprising:

a case means holding a stack of sheets of paper which are to be fed from the case means in a forward feed direction, said stack of sheets having an uppermost sheet, said sheets each having a forward leading edge, said case means having a front end portion juxtaposed to said forward leading edges of sheets in said stack, said case means having spaced sides extending from said front end portion to form front corners with said front end portion, corner claws disposed at said front corners, said corner claws each having a claw wall, the forward leading edge of said sheets in said stack being substantially disposed in a common plane which is disposed at an acute angle relative to said claw walls, said claw walls being operatively disposed forwardly of said leading edge of said sheets in said stack such that a part of the leading edge of said uppermost sheet in said stack abuts against each of said claw walls as said uppermost sheet initially commences to be fed, each of said claw walls being an inclined wall having an inclined inner end portion and an outer inclined end portion with said outer inclined end portion being disposed further from said sides than said inclined inner end portion and with said outer inclined end portion being disposed downstream of said inclined inner end portion.

16. A paper cassette according to claim 15, wherein said inclined wall has an upper end portion and a lower end portion with said upper end portion being downstream of said lower end portion considered in said forward feed direction.

17. A paper cassette according to claim 16, wherein said corner claws are pivotably mounted on said case means, said corner claws having engaging means engageable with said case means to limit the pivotal movement of said corner claws.

18. A paper cassette according to claim 17, wherein said engaging means is disposed downstream of said inclined walls considered in said forward feed direction.

* * * * *